US011400500B2

(12) United States Patent
Properzi

(10) Patent No.: US 11,400,500 B2
(45) Date of Patent: Aug. 2, 2022

(54) METHOD FOR CONVERTING WIRE ROD OF NONFERROUS METALS AND ALLOYS THEREOF TO WIRE WITH HIGH ELONGATION AND IN THE ANNEALED STATE

(71) Applicant: Giulio Properzi, Milan (IT)

(72) Inventor: Giulio Properzi, Milan (IT)

( * ) Notice: Subject to any disclaimer, the term of this patent is extended or adjusted under 35 U.S.C. 154(b) by 468 days.

(21) Appl. No.: 16/087,846

(22) PCT Filed: Mar. 24, 2017

(86) PCT No.: PCT/EP2017/057051

§ 371 (c)(1),
(2) Date: Sep. 24, 2018

(87) PCT Pub. No.: WO2017/162849

PCT Pub. Date: Sep. 28, 2017

(65) Prior Publication Data

US 2020/0298296 A1 Sep. 24, 2020

(30) Foreign Application Priority Data

Mar. 25, 2016 (IT) ..... 102016000031451

(51) Int. Cl.
*B21C 1/00* (2006.01)
*B21C 1/02* (2006.01)
(Continued)

(52) U.S. Cl.
CPC ..... *B21C 1/003* (2013.01); *B21C 1/02* (2013.01); *C22F 1/04* (2013.01); *C22F 1/08* (2013.01)

(58) Field of Classification Search
None
See application file for complete search history.

(56) References Cited

U.S. PATENT DOCUMENTS 2,886,428 A 5/1959 Osamu
3,613,767 A * 10/1971 Cofer ..... B22D 11/0602 164/476
(Continued)

FOREIGN PATENT DOCUMENTS

CN 102568669 A 7/2012
GB 1511087 A 5/1978
(Continued)

OTHER PUBLICATIONS

RU Office Action dated May 21, 2020 re: Application No. 2018137484/05, pp. 1-10, citing: U.S. Pat. No. 3,613,767 A, EP 2580005 A2, US 2006157167 A1 and SU 1289567 A1.
(Continued)

*Primary Examiner* — Brian D Walck
(74) *Attorney, Agent, or Firm* — Cantor Colburn LLP

(57) ABSTRACT

A method for converting wire rod of nonferrous metals and alloys thereof to wire with high elongation and in the annealed state, wherein the reduction in diameter in order to pass from wire rod to wire is carried out by way of a plastic deformation process. The temperature of the metal subjected to plastic deformation is controlled in order to have, at the end of the plastic deformation process, the wire at a temperature higher than or equal to the recrystallization temperature. This avoids the thermal treatment of annealing, necessary in conventional production techniques, achieving a considerable saving in production costs and a wire with characteristics similar to those of a wire subjected to annealing.

17 Claims, 5 Drawing Sheets

(51) Int. Cl.
*C22F 1/04* (2006.01)
*C22F 1/08* (2006.01)

(56) References Cited

U.S. PATENT DOCUMENTS

| | | | | |
|---|---|---|---|---|
| 3,933,660 | A * | 1/1976 | Tadenuma | C10M 173/02 508/408 |
| 4,066,475 | A | 1/1978 | Chia | |
| 4,132,662 | A | 1/1979 | Sturwold | |
| 4,402,766 | A | 9/1983 | Cloostermans-Huwaert | |
| 2006/0157167 | A1 * | 7/2006 | Kuroda | C22F 1/08 148/554 |
| 2010/0230069 | A1 * | 9/2010 | Aoyama | C22C 9/00 164/462 |
| 2012/0097422 | A1 * | 4/2012 | Sumi | H01B 1/026 174/117 F |

FOREIGN PATENT DOCUMENTS

| | | | |
|---|---|---|---|
| GB | 1536096 | A | 12/1978 |
| GB | 2096172 | A | 10/1982 |
| JP | S4956134 | U | 5/1974 |
| JP | S4926162 | B1 | 7/1974 |
| JP | S531669 | A | 1/1978 |
| JP | S57177961 | A | 11/1982 |
| JP | H03100196 | A | 4/1991 |
| JP | H1192897 | A | 4/1999 |
| JP | 3107302 | B2 | 11/2000 |
| JP | 2006193807 | A | 7/2006 |
| JP | 2007217792 | A | 8/2007 |
| JP | 2010234442 | A | 10/2010 |
| JP | 2012089386 | A | 5/2012 |
| JP | 2015028903 | A | 2/2015 |
| SU | 1289567 | A1 | 2/1987 |
| WO | 2011154914 | A2 | 12/2011 |

OTHER PUBLICATIONS

EP Examination Report dated Sep. 30, 2019 re: Application No. 17 714 410.2-1108, pp. 1-4, citing: U.S. Pat. No. 3,613,767 A, GB 1 536 096 A, JP 2015 028903 A, US 2006/157167 A1, US 2012/097422 A1, GB 2 096 172 A, US 2010/230069 A1, EP 2 580 005 A2, U.S. Pat. No. 2,886,428 A, JP H03 100196 A and JP 3 107302 B2.

International Search Report dated May 26, 2017 re: Application No. PCT/EP2017/057051, pp. 1-5, citing: U.S. Pat. No. 3,613,767 A, GB 1 536 096 A, JP 2015 028903 A, US 2006/157167 A1, US 2012/097422 A1, GB 2 096 172 A, US 2010/230069 A1 and EP 2 580 005 A2.

IT Search Report dated Oct. 14, 2016 re: Application No. IT UA20162023, pp. 1-8, citing: JP 2007 217792 A, JP 2015 028903 A, JP H11 92897 A, US 2006/157167 A1, US 2012/097422 A1, GB 2 096 172 A, US 2010/230069 A1 and EP 2 580 005 A2.

Written Opinion dated May 26, 2017 re: Application No. PCT/EP2017/057051, pp. 1-5, citing: U.S. Pat. No. 3,613,767 A, GB 1 536 096 A, JP 2015 028903 A, US 2006/157167 A1, US 2012/097422 A1, GB 2 096 172 A, US 2010/230069 A1 and EP 2 580 005 A2.

R M Shemenksi "The Ferrous Wire Handbook"; Dec. 31, 2008, pp. 811-862, XP055765942.

EP Communication dated Jan. 27, 2021, re: Application No. EP 17 714 410.2, pp. 1-7, citing: U.S. Pat. No. 3,613,767 A, GB 1 536 096 A, JP 2015 028903 A, US 2006/157187 A1, US 2012/097422 A1, GB 2 096 172 A, US 2010/230069 A1, EP 2 580 005 A2, U.S. Pat. No. 2,886,428 A, JP H03 100196 A, JP 3 107302 B2, R M Shemenski "The Ferrous Wire Handbook", U.S. Pat. No. 4 132 662 A and GB 1 511 087 A.

JP Office Action dated Feb. 15, 2021 re: Application No. 2019-501759, pp. 1-7, citing: JP 2015-028993A, JP S 57-177961A, JP S 49-0261628, JP S 53-001669A, JP 2012-089386A, JP 2010-234442A, JP 2006-193807A and JP S49-056134U.

* cited by examiner

METHOD FOR CONVERTING WIRE ROD OF NONFERROUS METALS AND ALLOYS THEREOF TO WIRE WITH HIGH ELONGATION AND IN THE ANNEALED STATE

TECHNICAL FIELD

The present disclosure relates to a method for converting wire rod of nonferrous metals and alloys thereof to wire with high elongation and in the annealed state. For the sake of simplicity, below the material of the wire rod and of the wire obtained from it will be referred to as "metal", whether this material is constituted by a metal or this material is constituted by a metallic alloy.

BACKGROUND

As is known, the initial processing of wire rod of nonferrous metals for electrical use, in particular of copper or aluminum, commonly known as the roughing step or simply roughing, is carried out using multistage die plates, both single-wire and double-wire, i.e. die plates that work simultaneously on two wire rods in parallel.

For ETP or FRHC or oxygen-free copper, the roughing die plates are substantially used to reduce wire rod of 8 mm diameter to a wire with a diameter comprised in the range 2-1.5 mm.

The range used most is in the neighborhood of 2-1.8 mm diameter, due to the fact that smaller diameters, as a result of the intrinsic limitations of the machine, excessively reduce hourly production.

For aluminum, the most common starting diameter, i.e. of wire rod, is 9.5 mm which is reduced to a minimum diameter of approximately 2.5 mm.

Multistage die plates are substantially made up of a series of die plates, alternated with drawing capstans. The wire is reduced to a smaller diameter since it has to pass through the conical hole of the die plate under the traction of the capstan.

The cold deformation produced by the drawing reduces the dimensions of the cells of the crystal lattice of the metal, and always produces a hardening effect on the metal, i.e. an increase of the breaking load with a simultaneous drastic lowering of the percentage elongation.

In some cases, this effect is pursued in order to increase the breaking load of the wire; in the majority of cases however, when the wire needs to undergo further cold processes, this hardening effect means the wire needs to be subjected to a thermal treatment of annealing since the wire, below certain elongation limits, is no longer plastic and ductile and breaks up under strain and therefore it is not possible to subject it to plastic deformation processes.

The necessity of annealing the wire after drawing is more important in the processing of aluminum alloys for mechanical uses and of copper than it is for pure aluminum, known as "E.C. grade", since this, generally, is not processed down to thin or even capillary diameters as happens with copper.

To optimize production, the industrial practice is to use, on the assembly line after the drawing, an annealer to restore the characteristics of the aluminum alloy or of the copper to the original state and that is to say to a condition of high workability and ductility. Since there are too many aluminum alloys for mechanical uses to describe the behavior of each one, the present description, although the method according to the disclosure can also be applied to aluminum alloys, will principally consider copper.

The line annealer is basically a heater and chiller of the wire, which is brought (usually by the Joule effect) first to the recrystallization temperature for a very short time, and then is returned to the ambient temperature with drastic cooling. This treatment is carried out in a controlled atmosphere in order to prevent the oxidation of the surface of the wire, which would occur as a consequence of the high temperature.

This thermal treatment cancels out the hardening that the copper underwent during the cold deformation in the die plate, restoring the elongation of the wire to the neighborhood of 35-40%, but it has a considerable influence on the production costs of the wire.

Purely by way of example, one of the best-known modern multistage, single-wire die plates on the market, which can convert wire rod with a diameter of 8 mm of ETP copper to a wire with a diameter of 2 mm at a production speed of 25 msec, requires the installation of approximately 350 kW of power for the die plate and approximately 220 kW for the annealer. In consideration of the fact that approximately 70% of the installed power is usually used, we have an actual consumption of 245 kWh for drawing and 154 kWh for the annealer.

With an hourly production rate of approximately 2.5 t/h, the annealing operation requires consumption of electric power in the neighborhood of 150 kWh divided by 2.5 t/h, i.e. about 60 kWh for each ton of wire produced.

Overall therefore, with a traditional method of this kind, about 160 kWh of energy is consumed per ton of wire produced.

The use of an annealer, necessary in conventional production techniques, has a considerable influence on the overall costs of production, both because of its amortization and because of the cost of the energy necessary for its operation, which is added to the energy required for the drawing.

SUMMARY

The aim of the present disclosure is to devise a method for converting wire rod of nonferrous metals and alloys thereof to wire with high elongation and in the annealed state, that makes it possible to appreciably reduce the overall costs of production.

Within this aim, the disclosure provides a method that does not require an annealer and which, therefore, removes both the purchase cost and the running costs of this component.

The disclosure also provides a method that can be carried out with conventional apparatuses or with apparatuses that can be derived, with modifications that are simple to carry out, from conventional apparatuses.

This aim and these and other advantages which will become better apparent hereinafter are achieved by providing a method for converting wire rod of nonferrous metals and alloys thereof to wire with high elongation and in the annealed state, in which the reduction in diameter in order to pass from wire rod to wire is carried out by way of a plastic deformation process, characterized in that the temperature of the metal subjected to plastic deformation is controlled in order to have, at the end of the plastic deformation process, the wire at a temperature higher than or equal to the recrystallization temperature.

BRIEF DESCRIPTION OF THE DRAWINGS

Further characteristics and advantages of the disclosure will become better apparent from the detailed description that follows of a preferred, but not exclusive, embodiment of the method according to the disclosure, which is illustrated by way of non-limiting example in the accompanying drawings wherein.

DETAILED DESCRIPTION OF THE DRAWINGS

Figure 1:
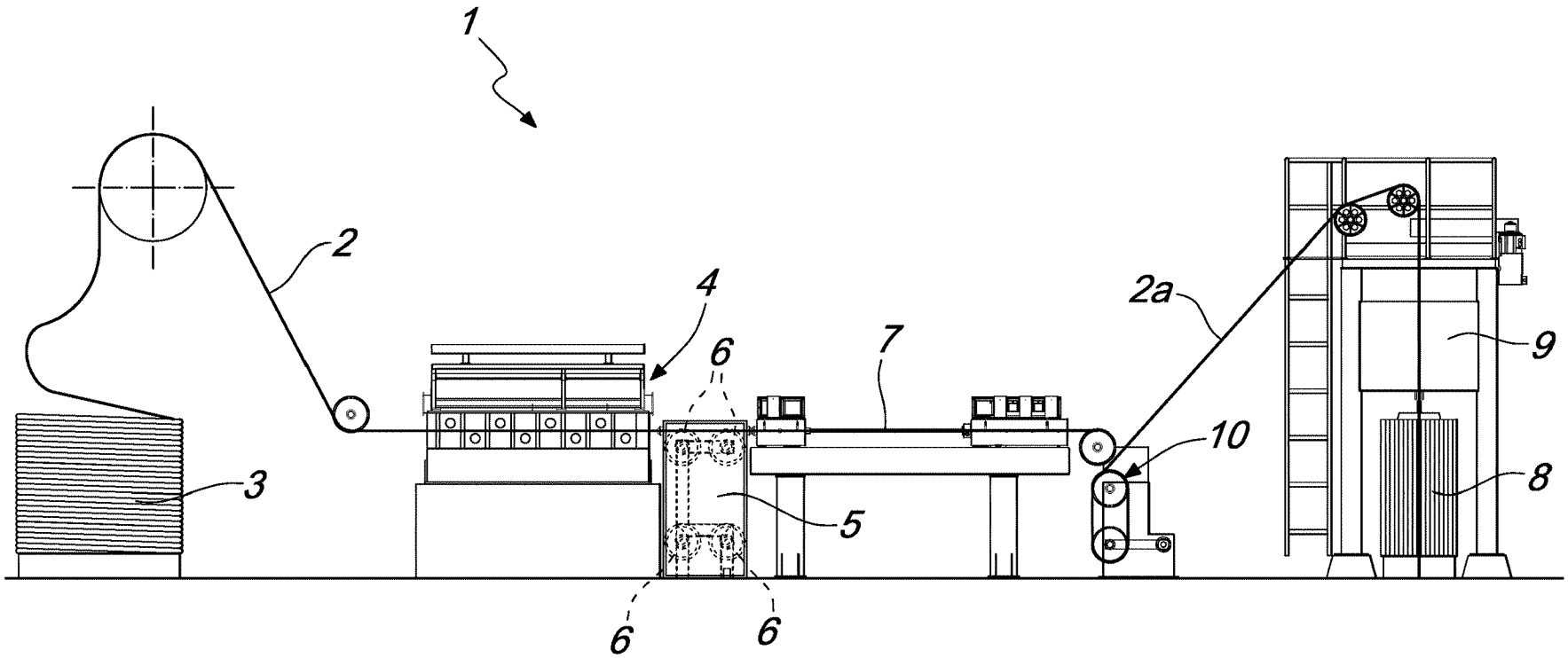
FIG. 1 is a schematic view of a plant for carrying out the method according to the disclosure.

With reference to FIGS. 1-3*b*, the method according to the disclosure is substantially based on using at least some of the mechanical energy, which is provided to the metal being worked in order to carry out the reduction in diameter thereof and which is converted to heat energy, in order to bring the metal being worked at least to the recrystallization temperature near the end of the processing to reduce the diameter. More specifically, in the method according to the disclosure, the reduction in diameter in order to pass from wire rod to wire is achieved by way of a plastic deformation process and the temperature of the metal subjected to plastic deformation is controlled so as to have, at the end of the plastic deformation process, the wire at a temperature higher than or equal to the recrystallization temperature.

Preferably, the plastic deformation process is adapted to produce a reduction of the area of the transverse cross-section of the wire rod at least of 85%.

Although the plastic deformation process in the method according to the disclosure can also be carried out by way of drawing or rolling, what is preferred is a rolling process, controlling the cooling of the metal being rolled in order to bring its temperature, at the end of the rolling process, at least to the recrystallization temperature of the metal.

In practice, the method according to the disclosure is based on exploiting, for annealing the metal, the power of the motor or motors that actuate the rolling units of the rolling mill and which is converted to heat inside the metal being worked. In the known art, this heat is completely removed by the cooling circuit of the die plates, which currently are used for roughing, or of the rolling units of rolling mills, by using, as a cooling agent, an emulsion composed of water and mineral or synthetic oil, or a special formulation with a percentage of oil generally comprised between 1% and 5% by weight calculated on the weight of the water.

The method according to the disclosure, instead, uses a cooling agent in liquid form with a different formulation, and a corresponding cooling circuit which however can control the extraction of heat from the metal being worked by raising its temperature in the final stages of rolling. This activity of controlling the extraction of heat, and that is to say of the final temperature of the metal, is easier using rolling mills since the dies of the die plates used nowadays are designed to work at low temperatures.

In substance, the metal, in the method according to the disclosure, during the rolling, is worked at a temperature that is higher than in conventional rolling methods and which is sufficient to obtain the recrystallization close to the completion of its reduction in diameter in the transition from wire rod to wire.

In this manner, a wire is obtained with a minimal hardening and that is to say with high elongation, which prevents any need for annealing before subsequent processing.

More specifically, the cooling agent used in conventional rolling methods, which also need to have lubricating properties in relation to the rolling cylinders, gaskets and other parts of the machine, is usually an emulsion of water and oil of specific formulation in which the oil is present in an amount comprised between 1% and 5% by weight with respect to the amount of water. In the method according to the disclosure, the cooling agent is also constituted by an emulsion of oil and water, but the oil is present in a percentage greater than 5% and up to 25% by weight with respect to the amount of water. Since the oil has a much lower specific heat capacity than water, this emulsion, which has a high proportion of oil, approximately reduces the extraction of heat in line with the ratio between the specific heat capacity of the oil and the specific heat capacity of water, and proportionally to the percentage of oil with respect to the percentage of water.

A plant for carrying out the method according to the disclosure is shown schematically in FIG. 1 and is generally designated by the reference numeral 1.

A wire rod 2, originating from a coil 3, enters a rolling mill 4 where it undergoes the reduction in diameter until it becomes wire, designated with the reference numeral 2*a*, and where, as explained above, it undergoes a heating that brings its temperature, in the final stages of the rolling, at least to the recrystallization temperature. The wire 2*a*, in output from the rolling mill 4, enters a chamber 5 with a non-oxidizing controlled atmosphere where it follows a section guided by pulleys 6 and, at the exit point of the chamber 5, it is cooled in a tube 7 in which a cooling emulsion flows at high speed. In output from the tube 7, the wire 2*a* is collected, in a way that is known per se, in a container 8 by a coiler 9 the speed of which is synchronized with that of the rolling mill 4 by way of a sensor 10.

The rolling mill used to carry out the method according to the disclosure is constituted by a rolling mill with rolling units arranged in line, i.e. in sequence, preferably a multi-stage precision rolling mill adapted to roll small diameters of ≤2 mm, for example, but not exclusively, a rolling mill of the Micro Rolling Mill type made by Continuus-Properzi S.p.A.

Figure 2A:
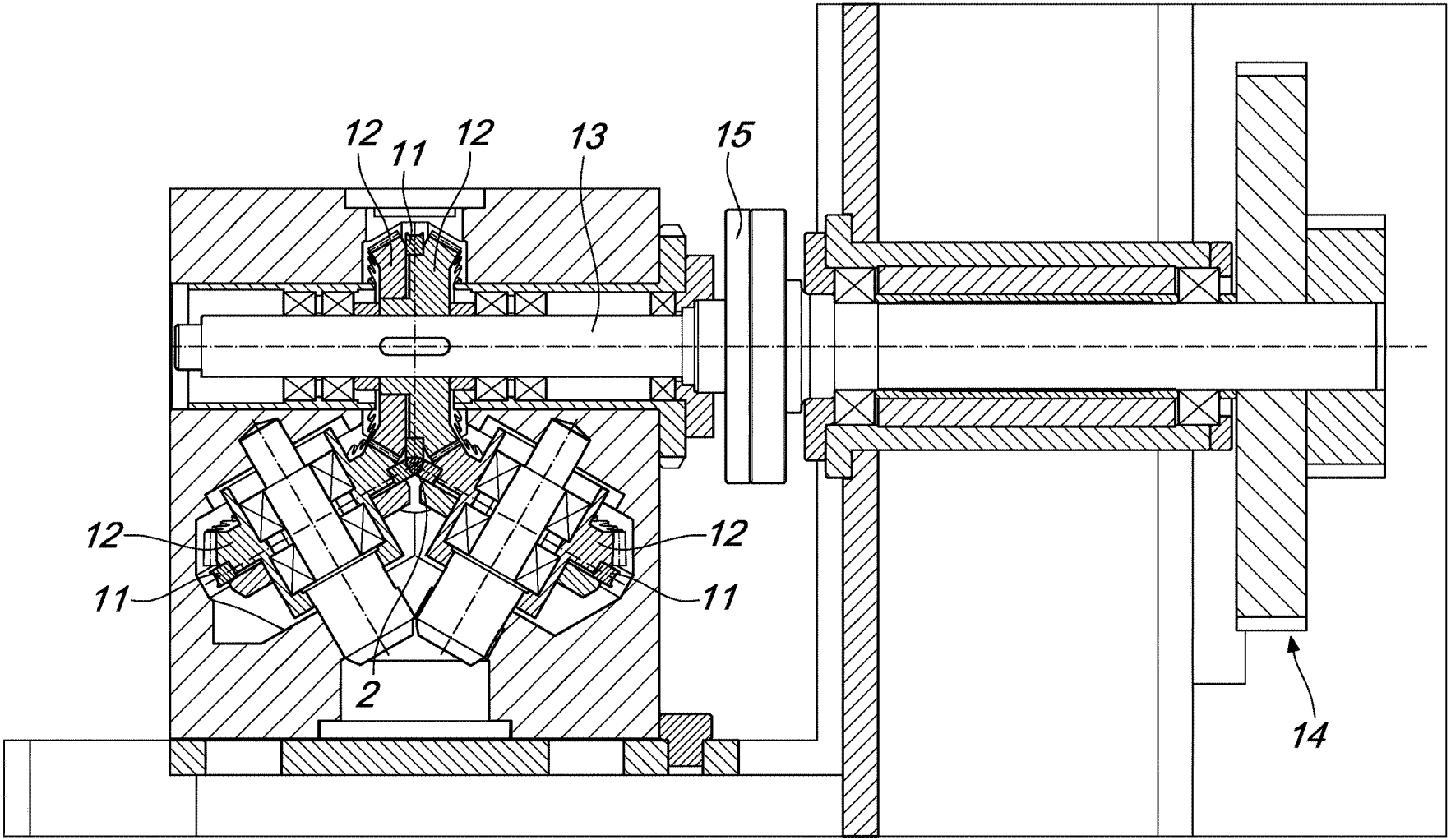
FIGS. 2*a* and 2*b* are schematic transverse cross-sectional views of the rolling cylinders of two contiguous rolling units of a type of rolling mill that can be used to carry out the method according to the disclosure.
Figure 2B:
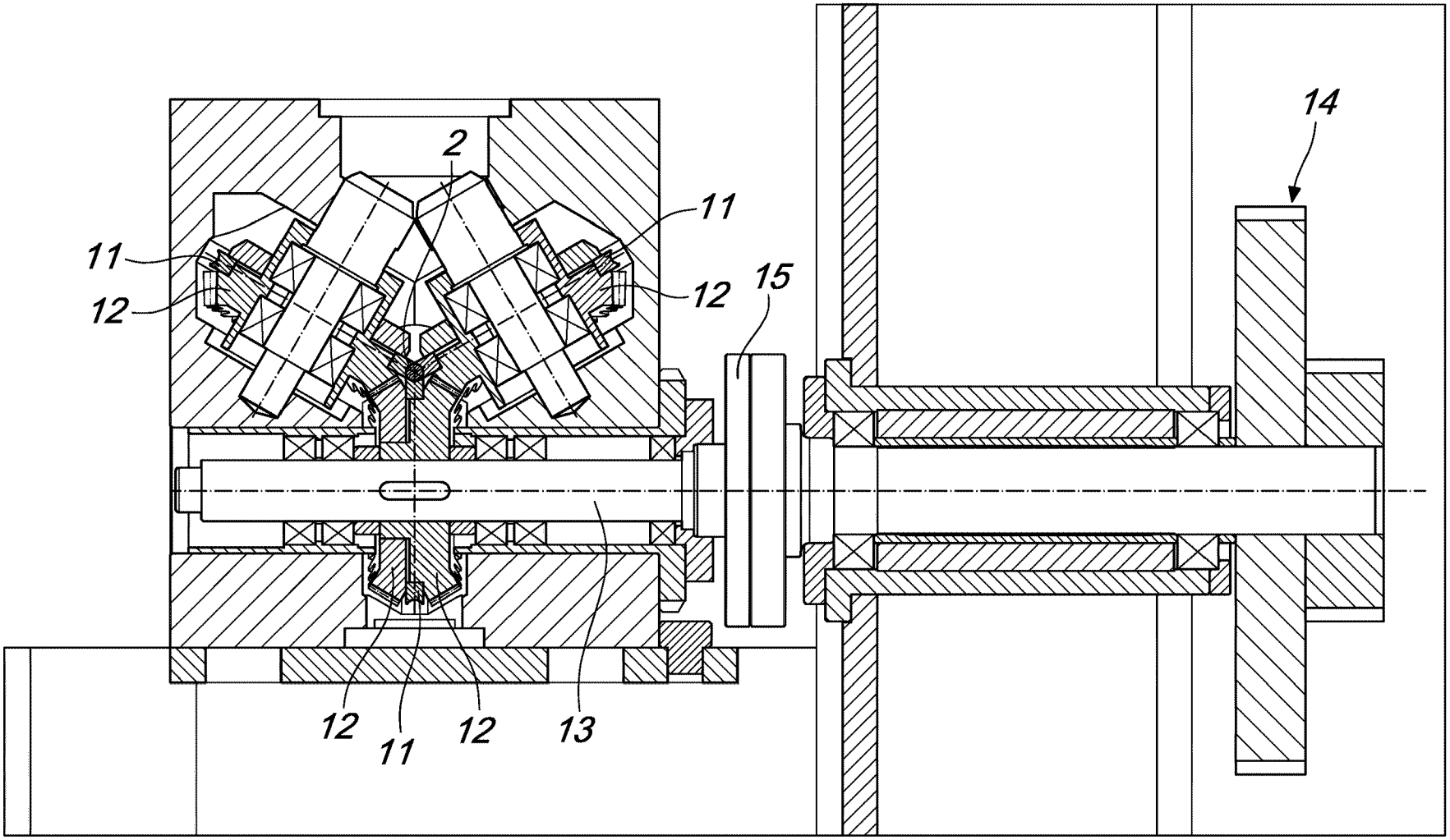

FIGS. 2*a* and 2*b* show two rolling units, of a rolling mill that can be used to carry out the method according to the disclosure, arranged in sequence with respect to each other along the path followed by the metal during the rolling. In each rolling unit, the rolling cylinders 11, three per unit and distributed about the axis of the wire rod 2, are connected, by way of gearwheels 12, to a driving shaft 13, which, in turn, is connected to a gearwheel transmission 14 by way of a joint 15. The gearwheel transmission 14 is connected to a motor, conventional and not shown for the sake of simplicity, which actuates the various rolling units. As can be seen, the rolling cylinders of the rolling unit shown in FIG. 2*a* are contoured so as to obtain, for the wire rod 2, a triangular cross-section with rounded vertices, while the rolling cylinders of the rolling unit shown in FIG. 2*b* are contoured so as to obtain, for the wire rod 2, a circular or round cross-section. The rolling units of the rolling mill are arranged so as to progressively produce a deformation of the transverse cross-section of the wire rod in a triangle-circle-triangle sequence until the final circle.

Figure 3A:
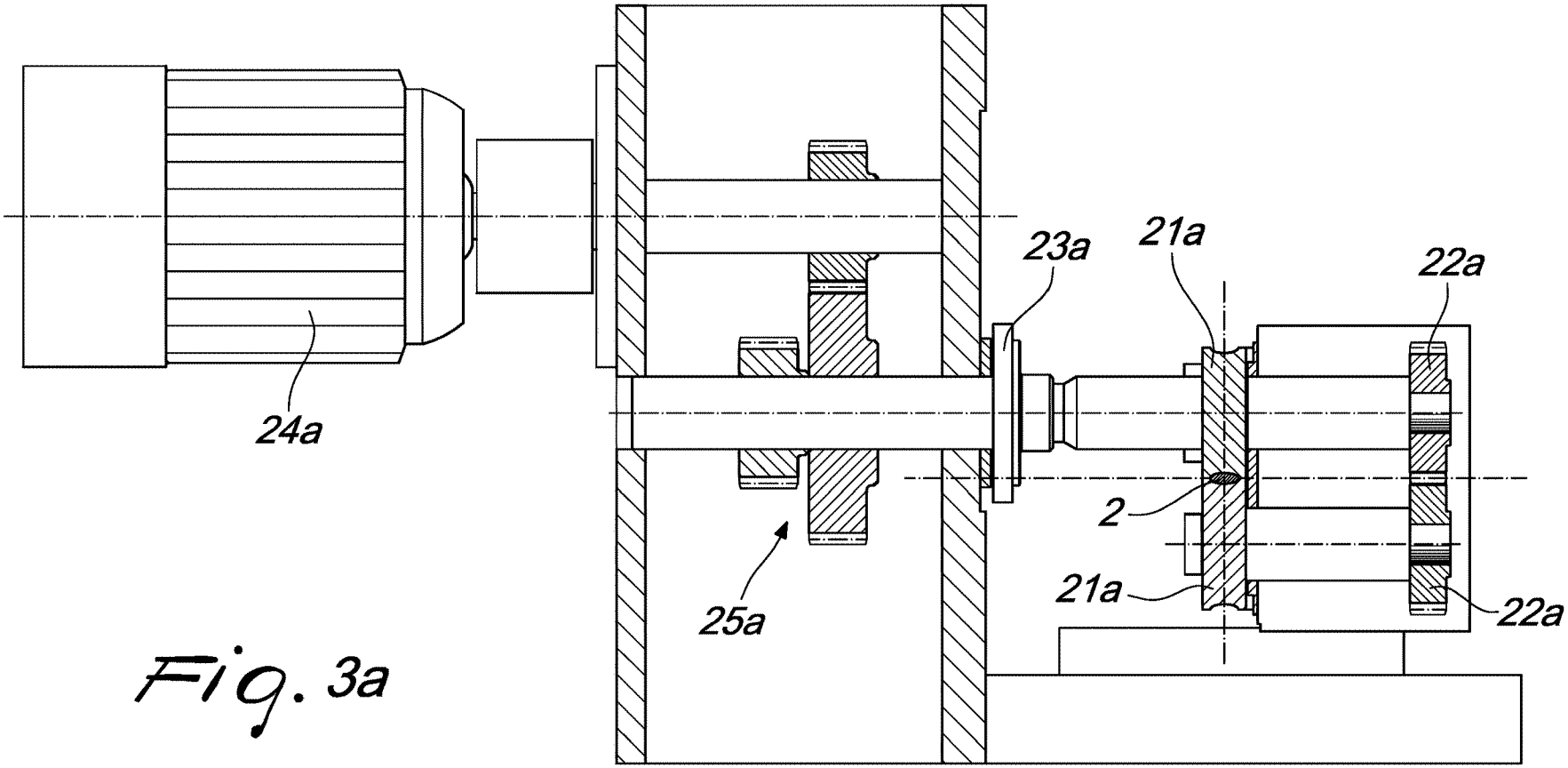
FIGS. 3*a* and 3*b* are schematic transverse cross-sectional views of the rolling cylinders of two contiguous rolling units of another type of rolling mill that can be used to carry out the method according to the disclosure.
Figure 3B:
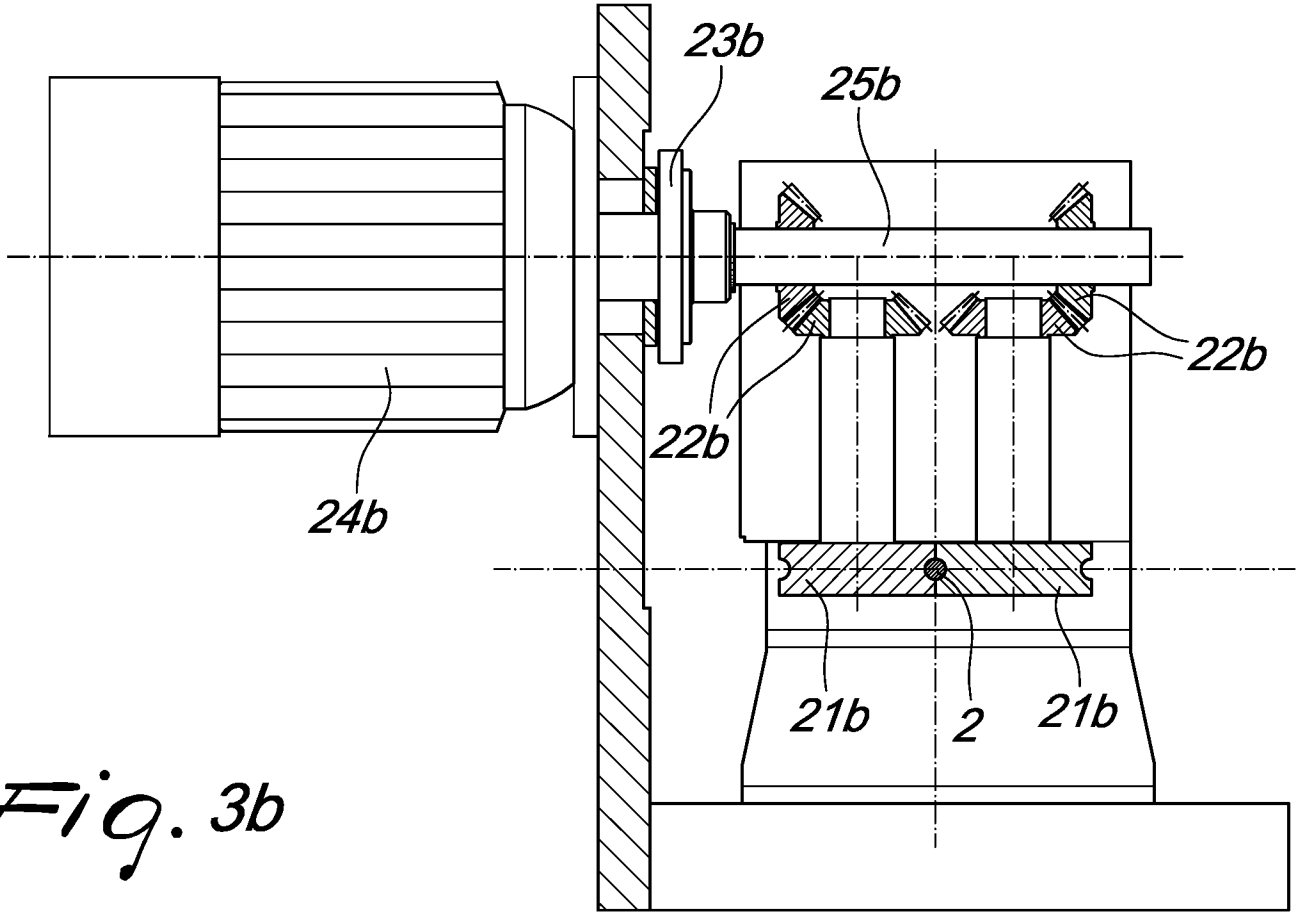

FIGS. 3*a* and 3*b* show two rolling units of a different type, also of a rolling mill that can be used to carry out the method according to the disclosure, arranged in sequence with respect to each other along the path followed by the metal during the rolling. In this case, each rolling unit is composed of two mutually opposite rolling cylinders 21*a*, 21*b* between which the wire rod 2 is made to pass. In the rolling unit shown in FIG. 3*a*, the rolling cylinders 21*a* are mutually connected by gearwheels 22*a* and are connected, by way of a joint 23*a*, to a gearwheel transmission 25*a* which is connected, in turn, to a motor 24*a*. In the rolling unit shown in FIG. 3*b*, the rolling cylinders 21*b* are connected, by way of gearwheels 22*b*, to a driving shaft 25*b*, which, in turn, is connected to a corresponding motor 24*b* by way of a joint 23*b*. As can be seen, in this case, the rolling cylinders of the rolling unit shown in FIG. 3*a* are contoured so as to obtain, for the wire rod 2, an elliptical cross-section, while the rolling cylinders of the rolling unit shown in FIG. 3*b* are contoured so as to obtain, for the wire rod 2, a circular or round cross-section. The rolling units of the rolling mill are arranged so as to progressively produce a deformation of the transverse cross-section of the wire rod in a ellipse-circle-ellipse sequence until the final circle.

The distribution of the cooling agent in the various rolling units is minimized and can be pulsed and/or sinusoidal, i.e. the flow-rate of the emulsion can be adjusted from zero to the maximum and can vary along time intervals at will; for example, it can pass from zero to the maximum in 2 seconds and then return to zero in another 2 seconds, thus halving the average flow-rate of emulsion in the unit of time. This trend makes it possible not to damage the rolling cylinders, whether they are made of steel or carbide or ceramic, and/or the other mechanical parts, and at the same time reduce at will, in a vast range of possibilities, the heat extracted from the metal. Given that $C=K\cdot P\cdot \Delta T$, where C are the calories removed, P the flow-rate of the emulsion, $\Delta T$ the increase in temperature between the emulsion at the point of delivery and the emulsion at the point of output, and K the specific heat capacity of the emulsion, it will be necessary to decrease K, as previously explained, by increasing, with respect to the known art, the percentage of oil in the emulsion and minimizing the flow-rate thereof.

A second method of distribution of the emulsion is to control it differently from rolling unit to rolling unit; for example, using a higher flow-rate of emulsion in the first rolling units and reducing it to the minimum in the final rolling units, or vice versa.

In this manner a sufficient lubricant action of the emulsion is obtained and, at the same time, the cooling action is minimized, by ensuring that the majority of the power of the motor or motors that actuate the rolling units contributes to raising the temperature of the metal being worked.

Controlling the cooling provided by the emulsion, correlated with the output speed, which in the preferred embodiment is between 25 and 30 m/sec, and correlated with the absorbed power of the motor, can produce a wire 2 mm in diameter after the last rolling unit, at the desired recrystallization temperature of greater than or equal to 250° C.

The emulsion, according to requirements, can be distributed to all the rolling units or only to part of them. Furthermore, the emulsion can be distributed in atomized form.

Optionally, the emulsion used to control the temperature of the metal subjected to rolling can be additivated with a percentage of ethyl or methyl or isopropyl alcohol comprised between 1% and 3% calculated on the overall weight of the emulsion, in order to take advantage of the property of such alcohols to combine with oxygen thus chemically dissolving the oxidation of the surface of the wire, if it is made of copper.

In the tests carried out, it has also been found that the wire must remain at a temperature at least equal to the recrystallization temperature for the time necessary to obtain a sufficient recrystallization to ensure that the wire has an elongation of 35% or more before being cooled. The necessary time is at least ⅕ of a second and it is obtained by making the wire travel a path between transmission pulleys 6 located in the chamber 5 with the non-oxidizing controlled atmosphere.

The wire in output from the chamber with the controlled atmosphere 5 is finally cooled in the tube 7 by way of an emulsion that can be constituted by the same emulsion used to control the temperature in the rolling mill 4. By way of cooling in the tube 7, the temperature of the wire is brought below the oxidation temperature.

If the wire produced is to be sold more for aesthetic than technological reasons, seeing that by way of rolling roundness tolerances equal to ±1% can be obtained, then after cooling but still on the process line a skin pass can be executed with slight percentage reduction of area of less than 5%, so as to obtain an excellent surface finish with only a minimal reduction of the percentage elongation.

Purely by way of example, below are two examples of execution of the method according to the disclosure, compared with a conventional method executed with a modern multistage, single-wire die plate for converting wire rod with a diameter of 8 mm made of ETP copper to a wire with a diameter of 2 mm at a production speed of 25 m/sec.

Example 1

A first test of application of the method according to the disclosure was carried out with a plant of the type shown in FIG. 1, using as the rolling mill a Micro Rolling Mill produced by Continuus-Properzi S.p.A. of Milan, Italy equipped with a wire rod unwinder, a circuit for the cooling emulsion, a 250 kW single motor for actuating the rolling mill and a Niehoff coiler for collecting the wire.

The type of rolling mill used has eight rolling units, each with three cylinders with a theoretical diameter of 170 mm. The rolling sequence accepts copper wire rod of 8 mm diameter, and with triangle-circle-triangle steps reduces it to 2 mm diameter in output. Standard ETP copper wire rod was used, of diameter 8 mm purchased on the European market.

In output from the rolling mill, a series of six transmission pulleys forced the wire along a path of approximately 6 m in a chamber with a non-oxidizing controlled atmosphere, before entering a cooling tube fed by the same cooling emulsion as the rolling mill. The wire was then coiled in a known manner.

After some tests to stabilize operations, wire rod of 8 mm diameter was rolled, reaching a final diameter of 2 mm at 25 m/sec, equal to about 2,500 kg/h, with emulsion provided alternately to all the odd-numbered rolling units and after two seconds to the even-numbered rolling units; i.e. each rolling unit received emulsion for two seconds at the rate of 10 l/min, alternated with two seconds without emulsion. The percentage of synthetic oil in the water to form the emulsion was kept between 10% and 11%. The elongation of the wire collected in the coil was constantly kept higher than 40% while for a similar conventional die plate processing one would instead obtain an elongation ≤5% before annealing.

As mentioned above, the overall energy consumption of a die plate plus an annealer, i.e. using a method of the conventional type, is in the neighborhood of 160 kWh per ton of wire produced, according to the data in the proposals from makers and the operating data gathered.

The new method carried out using a Micro Rolling Mill model of rolling mill enabled an average energy saving during tests of about 50%, since consumption of only 83-85 kWh occurred per ton of wire produced.

Example 2

In a second test, carried out using the same plant used in example 1, the same wire rod was rolled at the same speed as in example 1 and to the same final diameter. In this second test, the emulsion was distributed uniformly to all the rolling units but at high pressure and using sprayers that atomized the emulsion proper. The point of equilibrium that yielded (as in the first test) wire of 2 mm diameter with an elongation of 40% was reached with a total flow-rate of emulsion equal to 45 l/min in the eight rolling units. High-temperature bearings were used in the last four rolling units.

The total energy consumption, in this second test also, was found to be still very advantageous with respect to the methods of the known art, stabilizing at about 85 kWh per ton of wire produced.

In practice it has been found that the method according to the disclosure fully achieves the set aim since, by eliminating the need to use an annealer, it makes it possible to appreciably reduce the production costs of the wire.

With the method according to the disclosure, not only is the power for the annealer saved, but a saving is also obtained in the plastic deformation process of the metal, since deformation by rolling requires less energy than that through a series of dies and this is due to the intrinsic difference in the deformation of the metal crystals in the two types of deformation, and also because raising the temperature of the metal means that less energy is required for deformation during the rolling.

The method according to the disclosure also brings an environmental advantage; in fact, the industrial water circuit that cools the emulsion and the corresponding cooling tower also releases an amount of heat into the environment that is practically halved with respect to a plant with die plate and annealer.

Another advantage of the method according to the disclosure is that it makes it possible to carry out the roughing of non-ferrous wire rod with more compact and quieter plants.

Although the disclosure has been described predominantly with reference to the processing of copper, it can also be used for processing aluminum alloys by controlling the temperature of the metal so as to obtain, at the end of the plastic deformation process of the metal in order to obtain wire with the desired diameter from wire rod, a wire with a temperature greater than or equal to the recrystallization temperature of the metal being worked.

The method, thus conceived, is susceptible of numerous modifications and variations, all of which are within the scope of the appended claims Thus, for example, instead of using motorized rolling cylinders, idle rolling cylinders can be used alternated with motorized capstans that entrain the wire being worked. The plastic deformation of the metal in order to obtain the desired reduction in diameter in the transition from wire rod to wire, ultimately, can also be implemented with die plates as long as they are modified with respect to conventional die plates, which are designed to work at low temperatures, so that, in the final step of the plastic deformation temperature is reached that is at least equal to the recrystallization temperature of the metal being worked.

Moreover, all the details may be substituted by other, technically equivalent elements.

The disclosures in Italian Patent Application No. 102016000031451 (UA2016A002023) from which this application claims priority are incorporated herein by reference.

The invention claimed is:

1. A method for converting wire rod of nonferrous metals and alloys thereof to wire with elongation and in the annealed state, in which the reduction in diameter in order to pass from wire rod with a diameter of at least 8 mm-9.5 mm to wire with a diameter of 1.5 mm-2.5 mm is carried out by way of a plastic deformation process, wherein the temperature of the metal subjected to plastic deformation is controlled in order to have, at the end of the plastic deformation process, the wire at a temperature higher than or equal to the recrystallization temperature.

2. The method according to claim 1, wherein said plastic deformation process is adapted to produce a reduction of the area of the transverse cross-section of the wire rod at least equal to 85%.

3. The method according to claim 2, wherein the reduction in diameter in order to pass from wire rod to wire is carried out by way of a rolling process, controlling the cooling of the metal being rolled in order to bring its temperature, at the end of the rolling process, to a temperature that is higher than or at least equal to the recrystallization temperature of the metal.

4. The method according to claim 1, wherein the wire rod subjected to the plastic deformation process is made of ETP or FRHC or oxygen-free copper and the temperature of the wire at the end of the plastic deformation process is at least 250° C.

5. The method according to claim 3, wherein the cooling of the metal being rolled is controlled using as a cooling agent in the rolling process an emulsion of synthetic emulsifiable oil and water with a mass percentage of synthetic emulsifiable oil comprised between 5% and 25% with respect to the amount of water.

6. The method according to claim 3, wherein the rolling process is carried out by way of a rolling mill composed of rolling units arranged in succession, said emulsion of synthetic emulsifiable oil and water being distributed to all the rolling units.

7. The method according to claim 5, wherein the rolling process is carried out by way of a rolling mill composed of rolling units arranged in succession, said emulsion being distributed to part of said rolling units.

8. The method according to claim 7, wherein said emulsion is distributed in a pulsed manner to at least part of said rolling units.

9. The method according to claim 7, wherein said emulsion is distributed in a pulsed manner to at least part of said rolling units with a variable pulsing period.

10. The method according to claim 7, wherein said emulsion is distributed to at least part of said rolling units in atomized form.

11. The method according to claim 3, wherein the wire, after the rolling process, is kept in a non-oxidizing atmosphere for a preset time.

12. The method according to claim 3, wherein the wire, after the rolling process, is kept in a non-oxidizing atmosphere for a time equal to at least ⅕ of a second.

13. The method according to claim 3, wherein the wire, after the rolling process, is subjected to cooling in order to bring its temperature below the oxidation temperature.

14. The method according to claim 3, wherein the wire, after the rolling process, is subjected to cooling in order to bring its temperature below the oxidation temperature.

15. The method according to claim 3, wherein the wire, after said rolling process, is subjected to a surface finishing drawing step.

16. The method according to claim 5, wherein said cooling of the metal being rolled, after the rolling process, is carried out by way of the same emulsion used to control the cooling of the metal being rolled.

17. The method according to claim 5, wherein said emulsion is supplemented with a mass percentage of ethyl or methyl or isopropyl alcohol comprised between 1% and 3%.

* * * * *